US007400093B2

(12) United States Patent
Salop et al.

(10) Patent No.: US 7,400,093 B2
(45) Date of Patent: Jul. 15, 2008

(54) STANDING WAVE PARTICLE BEAM ACCELERATOR

(75) Inventors: Arthur Salop, Palo Alto, CA (US); David H. Whittum, Sunnyvale, CA (US); Michael A. Kauffman, Palo Alto, CA (US); Mark E. Trail, Menlo Park, CA (US); Gard E. Meddaugh, Mountain View, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 159 days.

(21) Appl. No.: 10/957,212

(22) Filed: Oct. 1, 2004

(65) Prior Publication Data

US 2005/0134203 A1 Jun. 23, 2005

Related U.S. Application Data

(63) Continuation-in-part of application No. 10/407,101, filed on Apr. 3, 2003, now Pat. No. 6,864,633.

(51) Int. Cl.
*H01J 25/10* (2006.01)

(52) U.S. Cl. ..... 315/5.41; 315/5.42; 315/500; 315/501

(58) Field of Classification Search ..... 315/5.41, 315/5.42, 500, 505
See application file for complete search history.

(56) References Cited

U.S. PATENT DOCUMENTS

| | | | | |
|---|---|---|---|---|
| 4,024,426 | A | 5/1977 | Vaguine | |
| 4,122,373 | A | 10/1978 | Vaguine | |
| 4,155,027 | A | 5/1979 | Schriber et al. | |
| 4,160,189 | A | 7/1979 | Tran et al. | |
| 4,286,192 | A | 8/1981 | Tanabe et al. | |
| 4,521,901 | A * | 6/1985 | Rand | 378/138 |
| 4,570,456 | A * | 2/1986 | Reimann et al. | 62/476 |
| 4,639,641 | A | 1/1987 | Tronc | |
| 4,855,604 | A * | 8/1989 | Riahi | 250/492.2 |
| 4,896,008 | A * | 1/1990 | Aoki et al. | 218/134 |
| 4,975,652 | A | 12/1990 | Tronc | |
| 4,988,919 | A | 1/1991 | Tanabe et al. | |
| 4,993,055 | A * | 2/1991 | Rand et al. | 378/125 |
| 5,105,456 | A * | 4/1992 | Rand et al. | 378/125 |

(Continued)

OTHER PUBLICATIONS

DE97007132/XAB, Inductance Voltage adder (IVA) for submillimeter radius electron beam. Mazarakis, M.G,; 1996, 1 page.*

(Continued)

*Primary Examiner*—Trinh Vo Dinh
(74) *Attorney, Agent, or Firm*—Bingham McCutchen LLP

(57) ABSTRACT

A method for generating an electron beam includes prescribing a location, and generating an envelope of electrons, the envelope having a waist, wherein the generating is performed such that the waist of the envelope is at or adjacent to the prescribed location. A device for generating an electron beam includes a gun source for generating electrons, and a plurality of electromagnetic cavities coupled in series to form a body, the electromagnetic cavities configured to accelerate at least some of the electrons to create a beam of electrons at an energy level having a value between 5 MeV and 20 MeV, the beam of electrons having a cross sectional dimension that is 0.02 λ (or 2 mm) or less.

46 Claims, 3 Drawing Sheets

U.S. PATENT DOCUMENTS

| | | | | |
|---|---|---|---|---|
| 5,381,072 | A | 1/1995 | Tanabe | |
| 5,714,757 | A * | 2/1998 | Itabashi et al. | 250/309 |
| 5,734,168 | A | 3/1998 | Yao | |
| 6,366,021 | B1 | 4/2002 | Meddaugh et al. | |
| 6,465,957 | B1 | 10/2002 | Whitham et al. | |
| 6,493,424 | B2 | 12/2002 | Whitham | |
| 6,538,397 | B1 * | 3/2003 | Ueno et al. | 315/382 |
| 6,646,383 | B2 | 11/2003 | Bertsche et al. | |
| 6,657,391 | B2 * | 12/2003 | Ding et al. | 315/5.41 |
| 6,864,633 | B2 | 10/2004 | Trail et al. | |
| 2004/0213375 | A1 * | 10/2004 | Bjorkholm et al. | 378/58 |

OTHER PUBLICATIONS

Gonichon, J. and Tronc, D., "*Acceleration and Bunching in a 6 MV X Band Linac*", GE Medical Systems, 3 pages.

McKeown, J. and Schriber, S., "Accelerating Structure with On-Axis Couplers for Electron Storage Rings", *IEEE Transactions on Nuclear Science* , Jun. 1981, pp. 2755-2757, vol. NS-28, No. 3.

Tronc, D. and Setty, A., "*Electrons RF Auto-Focusing and Capture in Bunchers*", Proceedings of the 1988 Linear Accelertor Conference, 1988,pp. 353-355, WE-19, General Electric, France.

Schonberg, R. G., et al., "*Portable; X-Band, Linear Accelerator Systems*", IEEE Transactions on Nuclear Science, Oct. 1985, pp. 3234-3236, vol. NS-32, No. 5, USA.

Sun, X. et al., "*The Design and Development of a 6 MEV X-Band On-Axis Coupling Standing Wave Linear Accelerator*", Proceedings of the 2001 Particle Accelerator Conference, Chicago, 2001, pp. 3900-3902, IEEE.

Xiang, S. et al, "*RF Phase Focusing and Asymmetric Field Shape in Standing -Wave Electron Linacs*", Tsinghua University, China, no date.

Huaibi, C. (presented by) of the Tsinghua Accelerator Lab, Beijing, China, "*Research on a 16MEV Backward Traveling Wave (BTW) Electron Linac*", Proceedings of the LINAC 2002 in Gyeongju, Korea, pp. 625-627.

Glatz, J. et al. "Beam Acceleration in the Single-Gap Resonator Section of the Unilac Using Alternating Phase Focusing" Proceedings of the EPAC 2002, Paris, France, pp. 897-899.

Miller, R.H. et al. "RF Phase Focusing in Portable X-Band, Linear Accelerator" IEEE Transactions on Nuclear Medicine Oct. 1985, pp. 3234-3236, vol. NS-32, No. 5.

Mazarakis, M.G. et al. "Inductive Voltage Adder (IVA) For Submillimeter Radius Electron Beam" Pulsed Power Conference, 1997. Digest of Technical Papers, (Jun. 1997) 1:642-650.

* cited by examiner

STANDING WAVE PARTICLE BEAM ACCELERATOR

RELATED APPLICATION DATA

This application is a continuation-in-part of U.S. patent application Ser. No. 10/407,101, filed on Apr. 3, 2003 now U.S. Pat. No. 6,864,633, the entire disclosure of which is expressly incorporated by reference herein.

BACKGROUND OF THE INVENTION

1. Field of the Invention

This invention relates generally to standing wave electron beam accelerators, and more particularly, to electron accelerators for generating x-ray and electron beams of different energies.

2. Background of the Invention

Standing wave electron beam accelerators have found wide usage in medical accelerators where the high energy electron beam is employed to generate x-rays for therapeutic and diagnostic purposes. Electron beam generated by an electron beam accelerator can also be used directly or indirectly to kill infectious pests, to sterilize objects, to change physical properties of objects, and to perform testing and inspection of objects, such as radioactive containers and concrete structures.

When using an electron beam accelerator for various applications, it is desirable that the generated electron beam has a small cross sectional dimension, and a sharp, well-focused high energy spectrum. It is also desirable to capture as many electrons as possible to thereby reduce current demands on the electron source (electron gun), to bunch the electrons efficiently to obtain desirable spectrum, and to confine the electrons by reducing defocusing effects. This in turn, will result in a generated electron beam that has a desirable output radiation yield. However, existing accelerators may not be able to generate electron beams having all these characteristics. For example, while an accelerator may generate an electron beam having a desirable cross sectional dimension, the output radiation yield associated with the generated electron beam may not reach a prescribed/desirable level.

Also, existing electron beam accelerators generally use external solenoids (or magnets) for focusing a particle beam. Use of external solenoids adds substantial weight to existing accelerators, increases cost of manufacturing, and makes it difficult to maneuver the accelerators (especially when the accelerator is being used to perform testing). As such, it would be desirable to have an electron beam accelerator that does not require external solenoids, while capable of generating electron beam having desired characteristics (e.g., well focused electron beam having high output radiation yield).

Further, many existing accelerators utilize electron sources that use high voltage (e.g., above 50 kV). However, such electron sources increase the size and weight of the overall accelerator, and complicate design and operation of the accelerator. Also, use of injection voltages over 50 kV may require insulation other than air, such as pressurized gas, vacuum, or oil, and use of injection voltages in the range of 20 to 50 kV may require detailing of the accelerator to reduce leakage, corona, and flashover (arcs). Generally, the higher the injection voltage used, the more effort is required to ensure personnel safety. As such, it would also be desirable to have an electron beam accelerator that uses a low voltage electron source while producing a well focused electron beam.

SUMMARY OF THE INVENTION

In accordance to some embodiments of the invention, a method for generating an electron beam includes prescribing a location relative to a cavity, and generating an envelope of electrons, the envelope having a waist, wherein the generating is performed such that the waist of the envelope is at or adjacent to the prescribed location.

In accordance to other embodiments of the invention, a device for generating an electron beam includes a structure having a proximal end, a distal end, a cavity located within the structure, and a channel located at the proximal end, the channel connected to the cavity, the cavity having a first portion and a second portion, wherein a cross-sectional dimension of the first portion is less than a cross-sectional dimension of the second portion, and a cathode located proximal to the structure, the cathode operable with an anode to generate an envelope of electrons, the envelope having a waist, wherein the waist of the envelope is located at or adjacent to either the location at which the channel meets the cavity, or a beginning of an increasing radiofrequency field.

In accordance to other embodiments of the invention, a method for generating an electron beam includes generating electrons, and accelerating the generated electrons to create a beam of electrons, the beam of electrons having an energy level being a value between 5 MeV and 20 MeV, the beam of electrons having a cross sectional dimension that is 2 mm or less.

In accordance to other embodiments of the invention, a device for generating an electron beam includes a gun source for generating electrons, and a plurality of electromagnetic cavities coupled in series to form a body, the electromagnetic cavities configured to accelerate at least some of the electrons to create a beam of electrons at an energy level having a value between 5 MeV and 20 MeV, the beam of electrons having a cross sectional dimension that is 2 mm or less.

Other and further aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
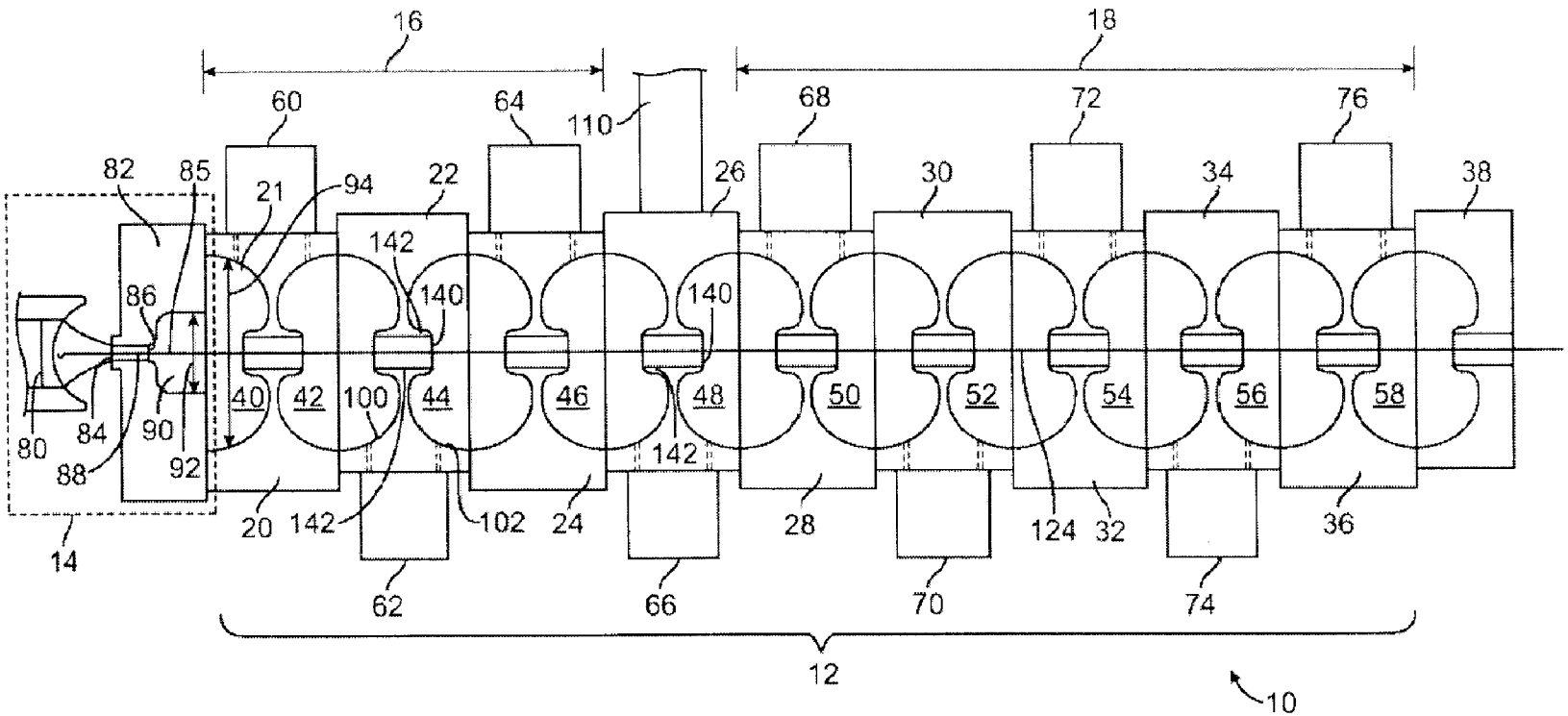
FIG. 1 is a schematic cross sectional view of a standing wave electron accelerator in accordance with some embodiments of the invention.

Various embodiments of the present invention are described hereinafter with reference to the figures. It should be noted that the figures are not drawn to scale and that elements of similar structures or functions are represented by like reference numerals throughout the figures. It should also be noted that the figures are only intended to facilitate the description of specific embodiments of the invention. They are not intended as an exhaustive description of the invention or as a limitation on the scope of the invention. In addition, an illustrated embodiment needs not have all the aspects or advantages of the invention shown. An aspect or an advantage described in conjunction with a particular embodiment of the present invention is not necessarily limited to that embodiment and can be practiced in any other embodiments of the present invention even if not so illustrated.

FIG. 1 is a schematic side sectional view of an electron beam standing wave accelerator 10 embodying embodiments of the invention. The accelerator 10 includes an electron source 14 for generating electrons, and a main body 12 coupled to the electron source 14 for bunching and accelerating the electrons. The main body 12 includes a plurality of axially aligned structures 20-38 and 82, forming cavities 40-58 (electromagnetically coupled resonant cavities) that are coupled in series. The accelerator 10 also includes a plurality of coupling bodies 60-76, each of which having a coupling cavity (not shown) that electromagnetically couples to two adjacent resonant cavities via irises or openings (e.g., openings 100, 102). Although the coupling bodies 60-76 are illustrated as side coupling bodies that are coupled to sides of the main body 12, in other embodiments, the coupling bodies 60-76 can be implemented as on-axis coupling cells to reduce the overall profile of the accelerator 10. The standing wave accelerator 10 is excited by microwave power delivered by a microwave source 110 at a frequency near its resonant frequency, for example, between 1000 MHz and 20 GHz, and more preferably, between 2800 and 3000 MHz. The microwave source can be a Magnetron or a Klystron, both of which are known in the art. The power enters one of the resonant cavities (e.g., cavity 48) along the chain, through an opening (not shown). Standing waves are induced in the resonant cells 40-58 by the applied microwave energy.

In the illustrated embodiments, the electromagnetic cavities (e.g., cavities 42, 44, etc.) are doughnut shaped with aligned central beam apertures (e.g., aperture 140) which permit passage of the electron beam 124. Alternatively, the electromagnetic cavities can have other shapes. The main body 12 defining the cavities has an outer cross sectional dimension approximately equal to the wavelength (λ) of the RF source, each cavity has a cross sectional dimension approximately equal to 0.7 λ to 0.9 λ, and the beam aperture 140 has a cross sectional dimension approximately equal to 0.05 λ to 0.07 λ. Also, in the illustrated embodiments, the distance between adjacent walls that separate the cavities is approximately 0.3 λ to 0.5 λ for the cavities that are in a first section 16, and the distance between adjacent walls that separate the cavities is approximately 0.5 λ for the cavities that are in a second section 18. In alternative embodiments, the cavities, the apertures, and other components of the accelerator 10 can have other shapes and/or dimensions. In some embodiments, the dimensions and/or spacing of the cavities in the first section 16 are configured to improve capture, bunching, and phasing of electrons. In the illustrated embodiments, the apertures 140 each has a substantially uniform cross section. Alternatively, the aperture 85 that is adjacent to the beam source 14 can have a varying cross section, such as a tapered profile, or a trumpet profile. The structures (e.g., structure 22) preferably have projecting noses (e.g., nose 142) of optimized configuration in order to improve efficiency of interaction of the microwave power and the electron beam 124. As discussed previously, the electromagnetic cavities are electromagnetically coupled together through the coupling cavities, each of which is coupled to each of the adjacent pair of electromagnetic cavities by an opening (e.g., openings 100, 102). In the illustrated embodiments, each of the openings 100, 102 has a rectangular shape, and has a width of approximately 0.045 λ and a length of approximately 0.3 λ. In alternative embodiments, the openings 100, 102 can have other shapes and dimensions. In the illustrated embodiments, the coupling cavities are of cylindrical shape with a pair of axially projecting conductive noses (not shown). Alternatively, the coupling cavities can have other shapes and configurations.

In some embodiments, most of the resonant cavities (e.g., 42, 44, etc.) are similar such that the fields' magnitudes in most of the electromagnetic cavities are substantially the same. Alternatively, the electromagnetic cavities can have other couplings or configurations (e.g., geometry or dimension) such that the fields in some of the cavities are different. The last cavity 58 is shown as a full cavity. However, in alternative embodiments, the cavity 58 can be a half cavity or any portion of a cavity.

The electron source (e.g., an electron gun) 14 includes a cathode 80 and an anode 82. During use, an electric potential is created across the cathode and the anode 80, 82, causing emission of electrons that are accelerated from the cathode 80 towards the anode 82. In the illustrated embodiments, the electron source 14 is configured to generate electrons at an energy level having a value (injection voltage) that is between 5 kilo-electron volts (keV) and 30 keV. Alternatively, the electron source 14 can be configured to generate electrons at other energy levels, and can be any of the gun sources known in the art.

Asymmetric Stepped Structure

In the illustrated embodiments, the cavity (buncher cavity) 40 is formed by the anode 82 and the structure 20. The bunch cavity 40 is configured to bunch and focus injected electrons from the electron source 14 to form a beam, and to establish the size of the beam while capturing a maximum number of electrons. In the illustrated embodiments, the first portion 90 of the cavity 40 has a cross sectional dimension 92 that is smaller than a cross sectional dimension 94 of the second portion 21 of the cavity. Such configuration creates an asymmetric step cavity, in which a RF-field magnitude is relatively lower in the first portion 90 than that in the second portion 21 of the cavity 40. In the first portion 90 of the cavity 40, electrons are bunched and are minimally accelerated. Particularly, late-arrival electrons are subjected to field phases that are relatively more favorable than electrons that arrived first, and as a result, late-arrival electrons catch up with the first electrons, forming a "bunch" with the first electrons. At the moment of entry into the second portion 21, the electrons, which are grouped in a bunch, are then accelerated across the cavity 40. As a result, electrons can be efficiently captured with high probability and bunched in the initially low-field region in the first portion 90 of the cavity 40, and then accelerated in the high field region in the second portion 21 of the cavity 40. To minimize the effect of field defocusing, the length of the cavity 40 is configured so as to assure that the RF accelerating field is close to the zero point in its cycle at the time the captured bunch approaches the cavity exit, where interaction with the field would cause a radially defocusing effect. Moreover, the location and geometry of the second cavity 42 is also configured to provide a net radial focusing as the bunch passes therethrough. Thus, the field is close to a maximum and has a focusing effect on the beam as the beam enters the cavity, and is close to zero and has a negligible defocusing effect on the beam as the beam exits from the cavity. Structures having asymmetric step cavities (asymmetric step structures) have been described in U.S. Pat. No. 4,975,652, the entire disclosure of which is expressly incorporated by reference herein.

Optimal Placement of Envelope Waist

Figure 2:
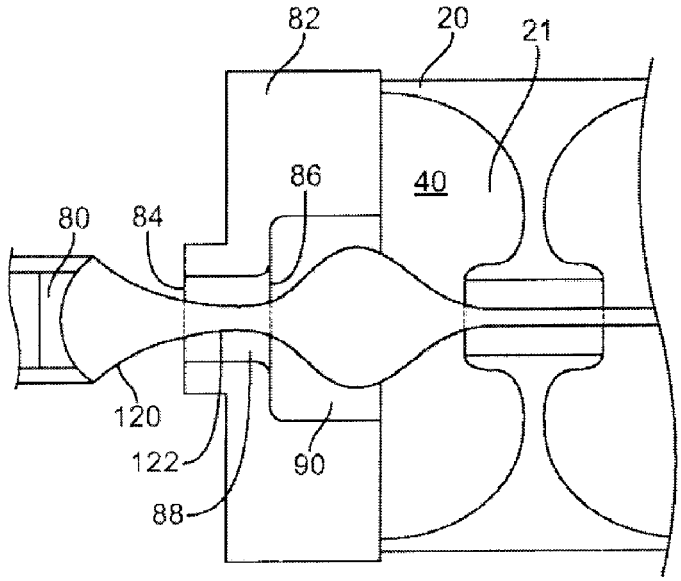
FIG. 2 is a close up side cross-sectional view of a proximal end of the accelerator of FIG. 1, illustrating an example of an envelope of electrons generated by the electron source of FIG. 1.

In the illustrated embodiments, the anode 82 also includes a channel (a drift tube) 88 connected to the first portion 90 of the cavity 40. In accordance with some embodiments of the invention, the electron source 14 is configured to generate an envelope 120 of electrons, wherein the envelope 120 has a waist 122 that is located at or adjacent to an interface 86 between the channel 88 and the first portion 90 of the cavity 40 (FIG. 2). For example, the waist 122 of the envelope 120 of electrons can be located within 0.02 λ (or 2 mm) proximal to the interface 86. Placing the waist 122 at such position relative to the buncher cavity 40 provides an optimal focusing of the electrons generated by the electron source 14. In other embodiments, the waist 122 of the envelope 120 can be located at other positions relative to the cavity 40 such that an electron beam having a desired characteristic can be created.

In the illustrated embodiments, the waist 122 is shown as the narrowest part of the envelope 120. Alternatively, the waist 122 as used herein can be another part of the envelope 120, such as, for example, a point along the envelope 120 that is within 1 mm from the narrowest part of the envelope 120. In other embodiments, the waist 122 can be at or near another point along the length of the envelope 120 at which the envelope is relatively narrow, for example, as compared to a portion of the envelope immediately before or immediately after the relatively narrow portion including at or near an inflection point in a continually converging or diverging portion of the envelope. Also, the term "envelope" is not limited to a region that includes all generated electrons, and can include a region that does not include all generated electrons. For example, in some embodiments, the envelope 120 can be defined as a region in which a density of electrons is above a prescribed level.

Figure 3:
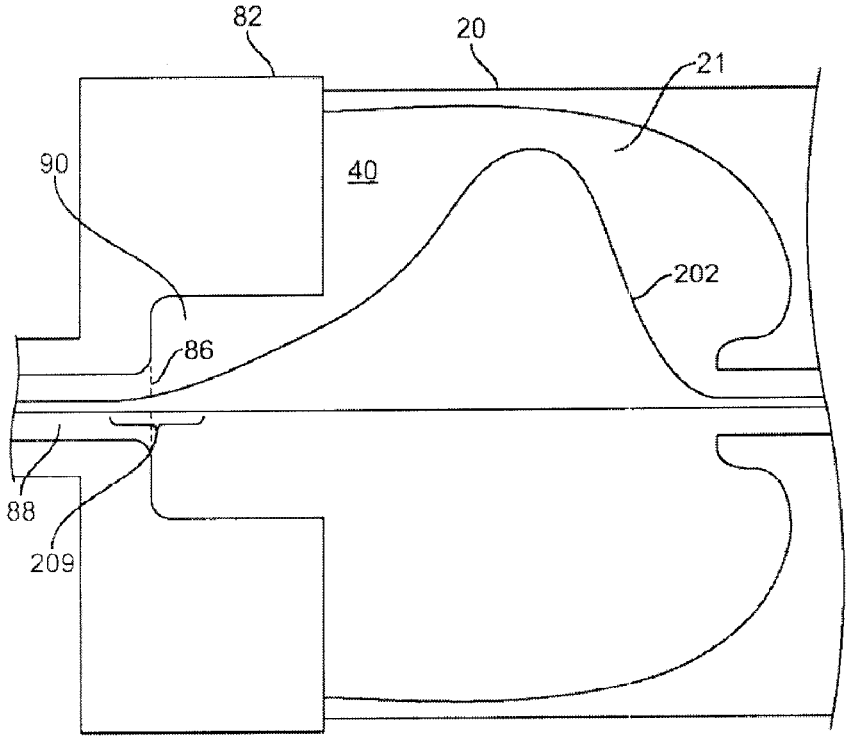
FIG. 3 is a diagram illustrating an example of a radio-frequency field within a buncher cavity.

FIG. 3 illustrates a diagram of an axial radiofrequency electric field 202 within the buncher cavity 40 and the drift tube 88. As shown in FIG. 3, the magnitude of the radiofrequency field 202 is close to zero in the drift tube 88 region and remains quite low although increasing approximately exponentially in the first small-diameter section of the step cavity. In the illustrated embodiments, the optimum location of the waist 122, determined using computer modeling, occurs in the region (e.g., region 209) of low but rising field close to the interface 86 between the drift tube 88 and the entrance plane of the first portion 90 of the cavity 40. Such optimal waist position can also be described as locating at a beginning of an increasing radiofrequency field. Placing the waist 122 at such position relative to the field 202 provides an optimal focusing of the electrons generated by the electron source 14. In other embodiments, the waist 122 can be located at other positions relative to the radiofrequency field 202 such that an electron beam having a desired characteristic can be created.

Various techniques can be employed to place the waist 122 at a desired/prescribed position. For example, the thickness of the anode 82, the geometry of the anode 82, and/or a configuration (e.g., a length or cross-sectional dimension) of the lumen 88, can be selected to place the waist 122 at the desired position. In other embodiments, the configuration of the electron source 14 and/or the geometry of the cavity 40 can be configured to place the waist 122 at a location relative to the radiofrequency field 202.

Figure 4:
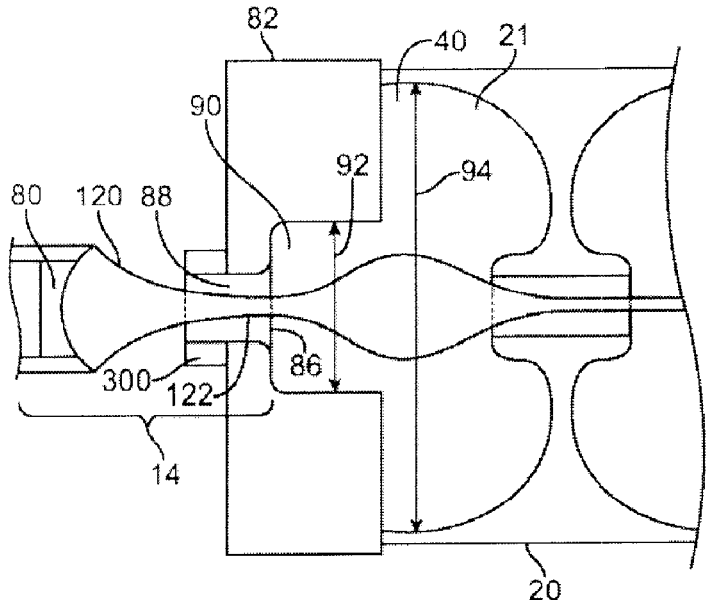
FIG. 4 is partial side cross-sectional view of an accelerator in accordance with other embodiments of the invention.

In the above described embodiments, the anode 82 is a wall that defines a part of the buncher cavity 40. However, the scope of the invention should not be so limited. In alternative embodiments, the anode can be a separate component 300 that is coupled to a wall defining at least a portion of the buncher cavity 40 (FIG. 4). In such cases, the structure 82 does not function as the anode, and the electron source 14 includes the cathode 80 and the anode 300, which is secured to the structure 82.

Cell Variation

As the electrons enter and exit the successive accelerating cavities 40-58, they are bunched and accelerated to create the beam 124 of electrons having desired characteristics. In the illustrated embodiments, the cavity 40, and to a certain extent, the cavity 42, are configured to bunch the electrons by accelerating later generated electrons a bit more than the earlier generated electrons per velocity modulation. The cavities (e.g., cavities 42, 44, etc.) following the cavity 40 are configured to constrain and focus the electrons traveling therethrough.

Bunching of the electron beam emerging from the electron source 14 takes place primarily in the first two cavities 40, 42. The geometry and field levels of the next several cavities are adjusted so as not only to accelerate the bunch electrons up to relativistic levels, but also to ensure that the bunch travels mainly behind the crest of a forward traveling-wave component of a standing-wave field where radial focusing occurs. The remaining downstream cavities are designed so as to further accelerate the now relativistic bunch electrons and to maintain the trajectory of the bunch close to the crest so that maximum acceleration is achieved. Radial focusing/defocusing effects are minimal at these highly relativistic energies where the effective particle mass has increased significantly.

In the illustrated embodiments, the cavities/cells 42-46 each has a first length along an axis of the accelerator 10, and the accelerating cavities/cells 48-58 each has a second length along an axis of the accelerator 10 that is different from the first length. In other embodiments, the cavities can be configured to have different lengths for allowing synchronization of the electron bunch in phase with respect to an imposed RF field (e.g., for achieving RF field focusing) for at least some of the cavities that the bunched electrons travel therethrough, thereby producing a maximum combination of beam transmission and spectral sharpness.

Other techniques can be used to synchronize at least some of the bunched electrons in phase with a desired portion (e.g., a point behind a crest, at a crest, or ahead a crest) of an imposed RF field. For examples, in other embodiments, instead of providing cells of different lengths at the first and the second sections 16, 18, cells at the first section 16 can have configurations (e.g., drift tube length, cross sectional dimension, cell geometry, nose shape, etc.) that are different from those in the second section 18.

In the illustrated embodiments, the cavity 40 and the cavities 42-46 are considered to be parts of the first section 16, and the cavities 48-58 are considered to be parts of the second section 18. In alternative embodiments, instead of having four cavities 40-46 in the first section 16, and six cavities 48-58 in the second section 18, the accelerator 10 can have other numbers of cavities (or cavity) in each of the sections 16, 18. For example, in some embodiments, the first section 16 of the accelerator 10 can have seven electromagnetic cavities, and the second section 18 of the accelerator 10 can have twenty electromagnetic cavities. Also, in alternative embodiments, instead of having two sets of cavities with different configurations, the accelerator 10 can have more or less than two sets of cavities, with the cavities in each of the sets having the same configuration, but different from those in other sets. For example, in other embodiments, each of the electromagnetic cavities of the accelerator 10 is individually configured (e.g., sized and shaped) to have a prescribed length for optimizing electrons bunching and/or acceleration, and therefore, may be different from an adjacent cavity.

EXAMPLE

A standing wave electron beam accelerator employing (1) waist position optimization (2) asymmetric stepped structure, and (3) cell length variation along the length of the accelerator, has been built. The accelerator includes a low voltage electron source that operates at 30 keV (or less), and a microwave source. In one mode of operation, the accelerator delivers a beam of electrons having an energy level of 9 MeV±0.5 MeV with at least 30% transmission (at least 30% of the electrons generated at a proximal end of the accelerator is transmitted to a distal end). In another mode of operation, the accelerator delivers a beam of electrons having an energy level of 5 MeV±0.5 MeV. By configuring the asymmetric stepped structure to place the waist of the electron envelope at optimal position, and by configuring the electromagnetic cavities to provide desired phase focusing effect, the electrons traveling though the accelerator can be efficiently bunched without use of an external solenoid. The above described configuration also allows the accelerator to deliver a beam of electrons that has a cross sectional dimension of 2 mm or less, without use of a collimator, measured at the point where the electron beam exits the last electromagnetic cavity.

It should be noted that accelerators having different configurations can be constructed in accordance with different embodiments of the invention. For example, in other embodiments, the accelerator can be configured to generate a beam of electrons having an energy level that is different from 9 MeV. In some embodiments, the accelerator 10 further includes a field step control (not shown), which provides a change in the electric field (e.g., a stepped field) to adjust the range of field variation. This use of field step allows the accelerator 10 to generate x-ray beam having different energy levels, thereby allowing the accelerator 10 to be designed for different energy outputs without redesigning the entire accelerator. For example, in some cases, use of field step(s) can enable the accelerator 10 to generate x-ray beam having an energy level that ranges from approximately 5 to 9 MeV, 3 to 5 MeV, 8 to 15 MeV, or 11 to 20 MeV, without changing the design of the proximal end of the accelerator 10. In some embodiments, field step(s) can be provided using an energy switch (not shown). Field step controls have been described in U.S. Pat. No. 6,366,021, and U.S. patent application Ser. No. 10/745,947, the entire disclosure of which is expressly incorporated by reference herein.

Also, in other embodiments, the accelerator can be configured to provide transmission that is different from 30% (e.g., anywhere between 10% to 50%), and/or a beam having a cross sectional dimension that is different from 2 mm (e.g., less than or greater than 2 mm).

Further, it should be understood by those skilled in the art that an embodiment of the accelerator needs not include all of the features described herein, and that in different embodiments, accelerators can be constructed to have one or a combination of the features described herein to produce electron beams having different characteristics. For examples, in other embodiments, instead of using a low voltage electron source, an electron beam accelerator can be constructed using a high voltage electron source and the technique of waist position optimization described herein.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. A method for generating an electron beam, comprising:

providing an electron source, a channel, and an electromagnetic cavity, wherein the channel is located between the electron source and the electromagnetic cavity, and wherein the channel has a first opening adjacent to the electron source, and a second opening that is in communication with the electromagnetic cavity; and generating an envelope of electrons, the envelope having a waist, wherein the waist of the envelope is at or adjacent to a location that is downstream from the first opening.

2. The method of claim 1, further comprising:

using the electrons to form a beam having a diameter that is 2 mm or less.

3. The method of claim 1, wherein the location is at a beginning of an increasing radiofrequency field.

4. The method of claim 1, wherein the location is at an interface between the channel and the electromagnetic cavity.

5. The method of claim 4, wherein the waist of the envelope of electrons is proximal to the interface.

6. The method of claim 4, wherein the waist of the envelope of electrons is within 2 mm from the interface.

7. The method of claim 1, further comprising:

accelerating at least some the electrons in the envelope using a body, the body having additional electromagnetic cavities coupled in series, the body having a proximal end and a distal end.

8. The method of claim 7, wherein the accelerating is performed such that at least 30% of electrons are transmitted from the proximal end to the distal end.

9. The method of claim 7, wherein the accelerating is performed such that the accelerated electrons result in an electron beam having an energy level that is at least 5 MeV.

10. The method of claim 7, wherein the accelerated electrons form a beam having a diameter that is 2 mm or less at the distal end.

11. The method of claim 1, wherein the generating is performed using a gun source that is configured to emit electrons at an energy level having a value between 5 keV and 30 keV.

12. The method of claim 1, further comprising confining at least some of the electrons in the envelope.

13. The method of claim 1, further comprising using the electrons to form a beam having an energy level that is at least 5 MeV.

14. The method of claim 1, wherein the waist comprises the narrowest part of the envelope.

15. The method of claim 1, wherein the waist comprises a portion of the envelope that is relatively narrower than another portion of the envelope.

16. A method for generating an electron beam, comprising:

generating an envelope of electrons, the envelope having a waist, wherein the waist of the envelope is at or adjacent to a location; and confining at least some of the electrons in the envelope, wherein the confining is performed without use of an external solenoid.

17. The method of claim 16, further comprising accelerating at least some the electrons in the envelope using a body, the body having electromagnetic cavities coupled in series, the body having a proximal end and a distal end.

18. The method of claim 17, wherein the accelerating is performed such that at least 30% of electrons are transmitted from the proximal end to the distal end.

19. The method of claim 16, further comprising using the electrons to form a beam having an energy level that is at least 5 MeV.

20. The method of claim 16, wherein the location is at an interface between a channel and an electromagnetic cavity, wherein the channel is located between an electron source and the electromagnetic cavity.

21. The method of claim 20, wherein the waist is located within 2 mm from the location.

22. The method of claim 20, wherein the waist is proximal to the interface.

23. The method of claim 16, wherein the waist comprises the narrowest part of the envelope.

24. The method of claim 16, wherein the waist comprises a portion of the envelope that is relatively narrower than another portion of the envelope.

25. The method of claim 16, wherein the envelope of electrons comprises a region in space that is occupied by the electrons.

26. The method of claim 16, wherein a boundary of the envelope of electrons is defined by a prescribed level of density of electrons.

27. A method for generating an electron beam, comprising:

generating electrons; and accelerating the generated electrons to create a beam of electrons, a portion of the beam of electrons having an energy level being a value between 5 MeV and 20 MeV, the portion of the beam of electrons having a cross sectional dimension that is 2 mm or less;

wherein the accelerating comprises using a cavity having a first section and a second section, a cross-sectional dimension of the first section is less than a cross-sectional dimension of the second section.

28. The method of claim 27, wherein the generating comprises creating an envelope of electrons, the envelope having a waist located at or adjacent to an interface between a channel and an electromagnetic cavity.

29. The device of claim 28, wherein the waist is located within 2 mm from the interface.

30. The device of claim 28, wherein the waist is proximal to the interface.

31. The device of claim 28, wherein the waist comprises the narrowest part of the envelope.

32. The device of claim 28, wherein the waist comprises a portion of the envelope that is relatively narrower than another portion of the envelope.

33. The method of claim 27, wherein the generating comprises creating an envelope of electrons, the envelope having a waist located at or adjacent to a beginning of an increasing radiofrequency field.

34. The method of claim 27, wherein the generating comprises using a gun source configured to emit electrons at an energy level having a value between 5 keV and 30 keV.

35. A method for generating an electron beam, comprising:

generating electrons;

accelerating the generated electrons to create a beam of electrons, a portion of the beam of electrons having an energy level being a value between 5 MeV and 20 MeV, the portion of the beam of electrons having a cross sectional dimension that is 2 mm or less; and confining at least some of the electrons as they are being accelerated, wherein the confining is performed without use of an external solenoid.

36. A device for generating an electron beam, comprising:

a gun source for generating electrons; and a plurality of electromagnetic cavities coupled in series to form a body, the electromagnetic cavities configured to accelerate at least some of the electrons to create a beam of electrons, a portion of the beam of electrons having an energy level being a value between 5 MeV and 20 MeV, the portion of the beam of electrons having a cross sectional dimension that is 2 mm or less.

37. The device of claim 36, wherein the gun source creates an envelope of electrons, the envelope having a waist located at or adjacent to an interface between a channel and one of the plurality of electromagnetic cavities.

38. The device of claim 37, wherein the waist is located within 2 mm from the interface.

39. The device of claim 37, wherein the waist is proximal to the interface.

40. The device of claim 37, wherein the waist comprises the narrowest part of the envelope.

41. The device of claim 37, wherein the waist comprises a portion of the envelope that is relatively narrower than another portion of the envelope.

42. The device of claim 36, wherein the gun source creates an envelope of electrons, the envelope having a waist located at or adjacent to a beginning of an increasing radiofrequency field.

43. The device of claim 36, wherein the gun source is configured to emit electrons at an energy level having a value between 5 keV and 30 keV.

44. The device of claim 36, wherein one of the plurality of cavities has a first section and a second section, a cross-sectional dimension of the first section is less than a cross-sectional dimension of the second section.

45. The device of claim 36, wherein one of the plurality of cavities has a length that is different from that of another of the plurality of cavities.

46. A device for generating an electron beam, comprising:

a gun source for generating electrons; and a plurality of electromagnetic cavities coupled in series to form a body, the electromagnetic cavities configured to accelerate at least some of the electrons to create a beam of electrons, a portion of the beam of electrons having an energy level being a value between 5 MeV and 20 MeV, the portion of the beam of electrons having a cross sectional dimension that is 2 mm or less;

wherein at least some of the electrons generated by the gun source is confined without use of an external solenoid.

* * * * *